US005351719A

United States Patent [19]

Graf

[11] Patent Number: 5,351,719

[45] Date of Patent: Oct. 4, 1994

[54] HEDDLE FRAME WITH DETACHABLE EDGE CONNECTIONS

[75] Inventor: Martin Graf, Horgenberg, Switzerland

[73] Assignee: Grob & Co. Aktiengesellschaft, Horgen, Switzerland

[21] Appl. No.: 768,306

[22] PCT Filed: Feb. 14, 1990

[86] PCT No.: PCT/CH90/00035

§ 371 Date: Mar. 29, 1993

§ 102(e) Date: Mar. 29, 1993

[87] PCT Pub. No.: WO91/12360

PCT Pub. Date: Aug. 22, 1991

[51] Int. Cl.[5] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 4,275,772 | 6/1981 | Shimizu | 139/91 |
| 4,349,052 | 9/1982 | Yaji et al. | 139/92 |
| 4,741,367 | 5/1988 | Kitawaki | 139/91 |
| 4,832,088 | 5/1989 | Palau | 139/91 |
| 4,883,095 | 11/1989 | Maruyama et al. | 139/91 |
| 5,004,019 | 4/1991 | Blontrock | 139/91 |
| 5,005,607 | 4/1991 | Shimizu | 139/91 |

FOREIGN PATENT DOCUMENTS

| | | |
|---|---|---|
| 0256406 | 2/1988 | European Pat. Off. . |
| 7608271 | 10/1976 | France . |

*Primary Examiner*—Andrew M. Falik

*Attorney, Agent, or Firm*—Nies, Kurz, Bergert & Tamburro

[57] ABSTRACT

A releasable corner structure for a heddle frame includes a projection carried by a side support, wherein the projection is received in a hollow space of a frame stave and is clamped in position by a clamping screw. The clamped projection is in the form of a flat body formed in one piece with the side support, and defines an outer frame having an opening within which flexible vibration dampers are positioned to lie between the outer frame of the projection and a metallic member that fits within and is spaced from the sides of the frame opening. The metallic member is riveted to a U-shaped sheet-metal casing that is adapted to surround the outer frame with a slight clearance space. Into the open top of the U-shaped sheet metal casing is riveted a rigid ledge member, against which the clamping screw acts. The side support projection is received within the frame stave and is separated therefrom by the vibration dampers, and therefore vibrations between the side support and the frame stave are damped and heddle frame breakage is prevented, especially when the machine in which the heddle frame is installed is operated at high speeds.

7 Claims, 2 Drawing Sheets

HEDDLE FRAME WITH DETACHABLE EDGE CONNECTIONS

BACKGROUND OF THE INVENTION

1. Field of the Invention

The invention relates to a heddle frame with detachable edge connections between the side supports and the frame staves consisting of hollow profiles, where at each edge joint a projection formed at the side support engages peg-like into a hollow space thereof and is clamped down by means of a screw.

2. Description of the Related Art

As is generally known, preferably light metal is nowadays used due to weight reasons, for the production of heddle frames. Such light metal, however, has the property that the alternating bending strength of this material, drawn as curve over the number of load changes, decreases continuously, unlike the case with steel after having reached a certain limit value. In the of light metal, due to the continuously dropping curve, a rupture of the material due to higher loading can happen at any time. The higher loading is caused to technical improvements that results in continuously increased speed of the weaving machines, in which the heddle frames are moved upwards and downwards. As a consequence load changes are produced on the heddle frames. At the current speeds of over 1000 movements per minute it is possible that ruptures can occur at the side supports, specifically below the peg-like projection that extends from a heddle frame side support.

SUMMARY OF THE INVENTION

The present invention has as an object to avoid ruptures of heddle frame material by means of structural measures. In order to meet this object the heddle frame includes spaced side supports and frame staves extending between the side supports. The frame staves include a hollow space at each end, and the side supports each have a projection mounted thereto, which projections are received in respective hollow spaces of the frame staves to permit connections between the side supports and the frame staves. Each projection includes a first rigid body securely mounted to a respective side support and also includes an opening. A second rigid body is provided and has a first portion adapted to be loosely received within the opening in the first rigid body. The second rigid body also includes a second portion overlying at least a part of the outer surface of the first rigid body. An elastic vibration damping element is positioned within the opening in the first rigid body, between the first portion of the second rigid body and the first rigid body. A clamping member is provided to connect the frame stave with the second portion of the second rigid body, for clampingly holding the second rigid body within the hollow space of the frame stave. Numerous embodiments of the invention are possible, and examples of these embodiments will be explained hereinbelow greater in detail greater based on the drawings.

DESCRIPTION OF THE PREFERRED EMBODIMENTS

Figure 1:
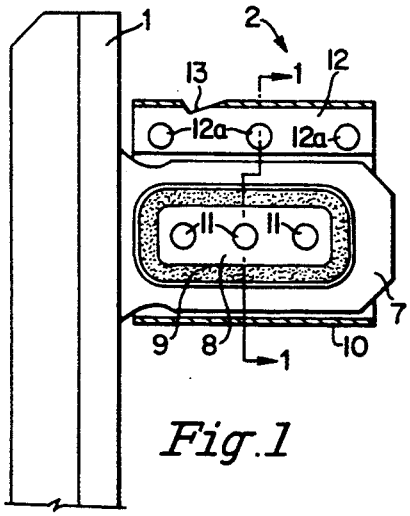
FIG. 1 is a fragmentary elevational view of the upper end of a heddle frame side support with a projection serving for mounting with a frame stave.
Figure 3:
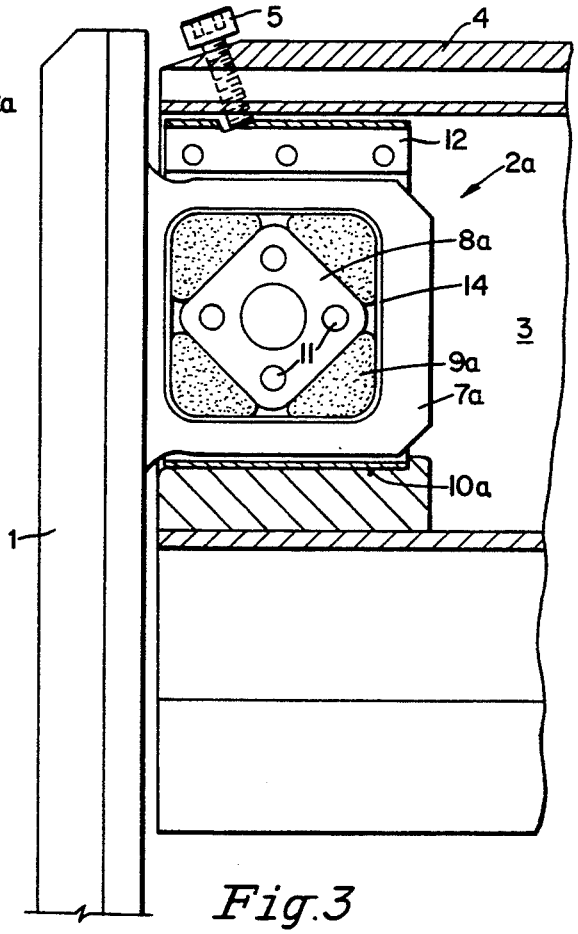
FIG. 3 shows a further modified embodiment of the projection formed at the side support, and also the mounting with a frame stave of a heddle frame.

The upper end of a side support 1 illustrated in FIG. 1 carries along one of its narrow sides a side projection 2 by means of which one of the edge connections of a heddle frame is made. At such an edge connection as illustrated in FIG. 3 projection 2 of side support 1 extends into the hollow space 3 of the frame stave 4 of the heddle frame and is clamped against the interior of the frame stave 4 by means of a clamping screw 5 that extends obliquely through the frame stave 4.

The embodiments illustrated in the figures differ from each other regarding the structure of the projection, which in accordance with the invention consists of two rigid bodies separated from each other by at least one vibration damper element, of which one rigid body is rigidly mounted to the side support and the other rigid body serves for receiving the clamping force in the frame stave 4 that is in the form of a hollow profile.

Figure 2:
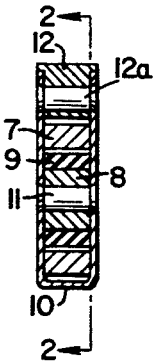
FIG. 2 is a vertical section through the projection taken along the line 1—1 of FIG. 1.
Figure 14:
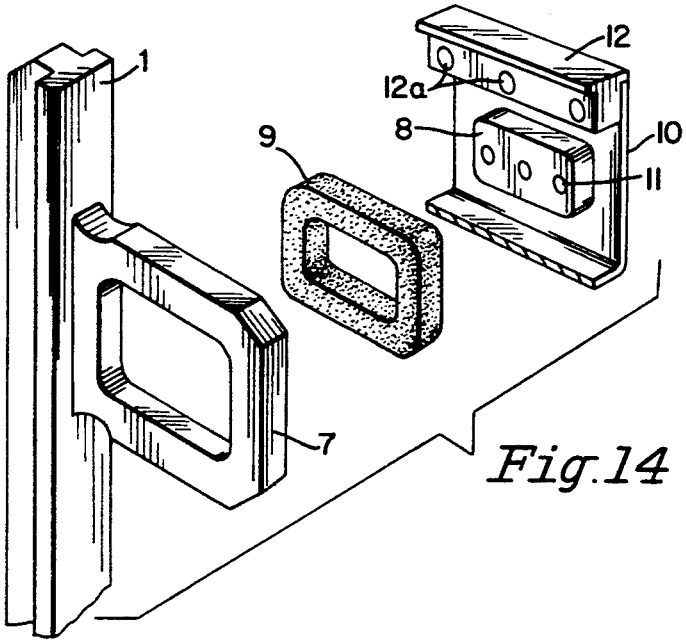
FIG. 14 is an exploded perspective view of the embodiment shown in FIGS. 1 and 2.

In the embodiment according to FIGS. 1, 2 and 14 the body 7, which is rigidly mounted to the side support 1, is a planar rectangular frame formed integrally with the side support 1. The part of the structural serving for receiving the clamping force and that engages with the projection is designed in all embodiments in several parts and consists in the embodiment according to FIG. 1 and 2 of a metallic part 8 extending laterally through an opening in the frame 7 and which is separated from the frame 7 by a vibration damper element 9 which fills out the interstice between frame 7 and part 8. Part 8 is rigidly connected to a U-shaped sheet metal cover 10 which surrounds and covers the major outside faces of the frame 7 in a manner to permit some play therebetween. The rigid connection is made in the embodiment according to FIG. 1 and 2 by three rivets 11, by means of which the part 8 is rigidly mounted to the sheet metal cover 10. Furthermore, a ledge 12 forms the upper closure for open top sheet metal cover 10 and is riveted thereto by rivets 12*a* to obtain an overall stable body which is suitable to be clamped down by means of the clamping screw 5 (see FIG. 3). FIG. 1 illustrates a section along line 2—2 in FIG. 2 whereby the ledge 12 which has narrowed side for the insertion of ledge 12 into the sheet metal enclosure 10 is sectioned at its upper, flange portion.

Figure 1A:
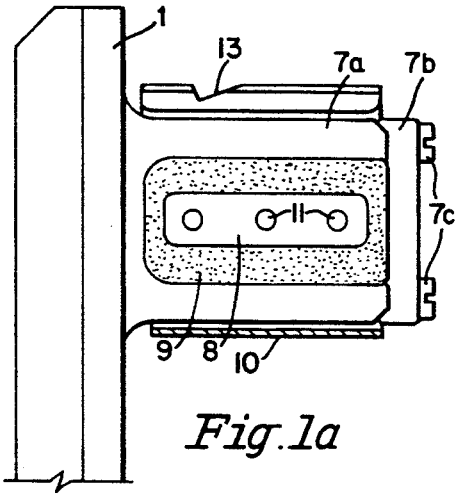
FIG. 1*a* is a fragmentary elevational view of a modified embodiment of the heddle frame side support shown in FIG. 1.

According to a somewhat modified embodiment shown in FIG. 1*a*, the frame 7*a*, which is rigidly mounted to the side support 1 is not formed as closed rectangular frame, but rather as a U-shaped frame, such that the vibration damper element 9 is to be inserted into the frame 7*a* from the open side opposite to the side support 1. A ledge 7*b*, forming the fourth side of the rectangular frame, is then screwed into the U-shaped frame 7*a* by means of screws 7*c*. By the structural arrangement shown in FIG. 1*a* the vibration damper element 9 can also be prestressed by ledge 76 in order to therewith influence the magnitude of the damping. Additionally, this embodiment permits replacing the vibration damper element mounted to the outer sheet metal cover 10 if damage makes such replacement necessary, or if one wants to exchange a vibration damper element with another one having different damping characteristics.

All further embodiments of the invention differ only by the number of the elastic vibration damper elements present and by the corresponding shape of the frame rigidly connected to the side support and of the part extending laterally thereinto, which is rigidly mounted to the sheet metal cover and forms together with the cover the the member that is clamped down when the heddle frame is assembled.

In the embodiment illustrated in FIG. 3 the projection 2*a* includes a somewhat larger frame 7*a* which is rigidly mounted to the side support 1 and, furthermore, a square shaped body 8*a* extending laterally through the frame 7*a* disposed so that the diagonals of body 8*a* extend substantially vertically and horizontally. Body 8*a* abuts four respectively triangular vibration damper elements 9*a* which include rounded corners and which fill in the respective triangular interstices between the frame 7*a* and body 8*a*. In order to facilitate the assembly of the parts a narrow hoop 14 surrounds the vibration damper elements 9*a* at the outside and is present in all subsequently described embodiments. As is the case of the first embodiment according to FIG. 1, the body 8*a* is riveted by rivets 11 to a U-shaped bent sheet metal cover 10*a* which surrounds and covers the major faces of frame 7*a* in a manner to permit some play therefrom and includes at the top a ledge 12 which is riveted to cover 10*a* in such to be able to be clamped down against the projection 2*a* by clamping screw 5.

A further modified embodiment, shown in FIGS. 7–13, differs only in that at projection 2*b* the disk body 8*b*, which extends laterally through the frame 7*b*, is of a star-like shape and abuts four vibration damper elements 9*b* which fill out the interstices in the edges of the frame.

Figure 8:
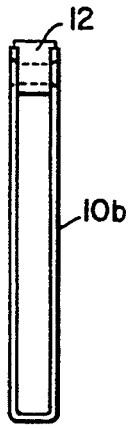
FIG. 8 shows an end vertical view of only the sheet metal over of the projection shown in FIG. 7.
Figure 9:
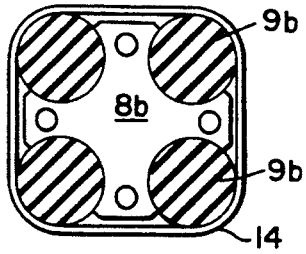
FIG. 9 is an elevational view of the damper elements used in the embodiment according to FIG. 7 positioned in the corners of a star-shaped disk body.
Figure 10:
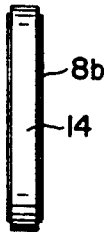
FIG. 10 shows an end vertical view of the arrangement of FIG. 9.
Figure 11:
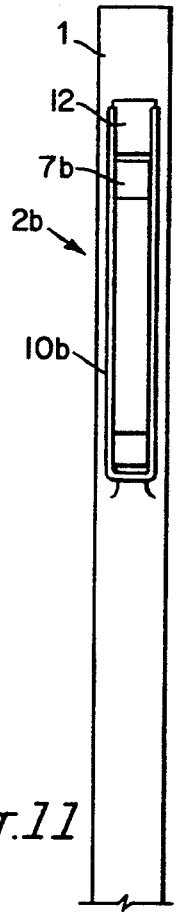
FIG. 11 shows a fragmentary end vertical view of the side support and projection shown in FIG. 7.
Figure 12:
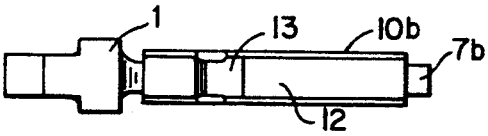
FIG. 12 shows a top view of the embodiment according to FIG. 7.
Figure 13:
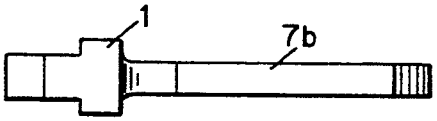
FIG. 13 is a top view similar to FIG. 12 but without the outer body of the projection.

FIG. 8 shows sheet metal cover 10*b* together with ledge 12 attached thereto by rivets 12*a*. Cover 10*b* has the same structure as sheet metal cover 10*a*. FIG. 9 shows disk body 8*b* that fits within frame 7*b* and that includes a ring 14 that surrounds vibration damper elements 9*b* and disk body 8*b*, and which is shown in side view in FIG. 10. FIG. 11 is a view of the narrow side of side support 1 that includes projection 2*b*. FIG. 12 shows a top view of frame 7*b* and surrounding sheet metal cover 10*b*, which fits therearound with a clearance space, while in the top view of FIG. 13 there is shown only side support 1 with the unitary connected frame 7*b*.

Figure 4:
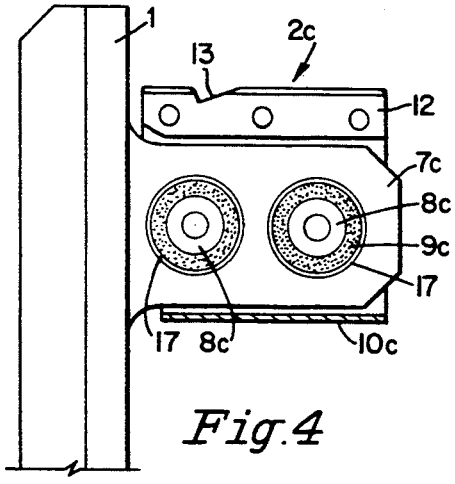
FIG. 4 shows a third modified embodiment of the side support projection.
Figure 5:
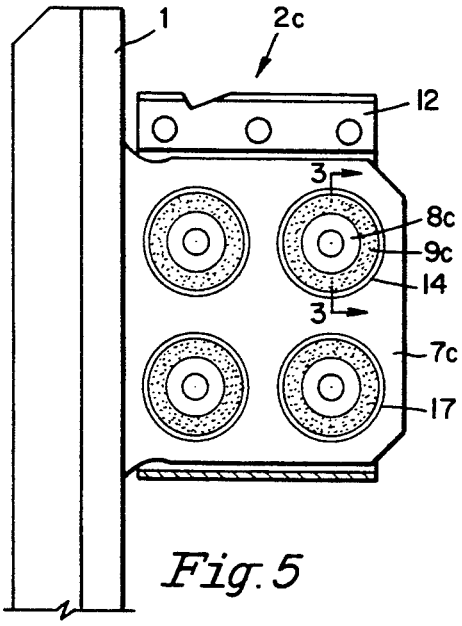
FIG. 5 shows a fourth modified embodiment of the side support projection.
Figure 6:
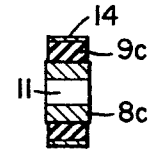
FIG. 6 is a vertical section through a damper element taken along the line 3—3 of FIG. 5.
Figure 7:
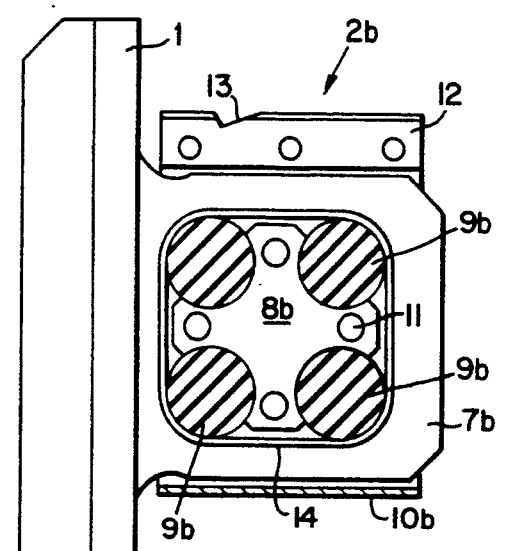
FIG. 7 shows a fifth modified embodiment of the side support projection.

Two additional embodiments are illustrated in FIGS. 4, 5 and 6, and which differ only regarding the number of vibration damper elements present. In the embodiment according to FIG. 4 the rectangular frame 7*c* rigidly connected to the side support 1 includes two cylindrical bores 17 extending through same. The part which extends laterally through the body 7*c* includes a number of disks 8*c* corresponding to the number of bores present, having a smaller diameter and located concentrically in the bores, which disks 8*c* abut respectively the annular vibration damper elements 9*c* filling out the interstices defined between disks 8*c* and bores 17 in frame 7*c*. In the embodiment according to claim 5, the rectangular frame 7*c* connected rigidly to the side support 1 includes four cylindrical bores 17 extending laterally therethrough. The part which extends laterally through the body 7*c* includes a number of disks 8*c* corresponding to the number of bores present, having a smaller diameter and located concentrically in the bores, which disks 8*c* abut respectively the annular vibration damper elements 9*c* filling out the interstices. In the embodiment according to FIG. 4 two, and in the embodiment according to FIG. 5, four annular vibration damper elements 9*c* are present. The disks 8*c* are riveted to an outer sheet metal cover 10*c* which surrounds the frame 7*c* at the outside in a manner to permit some play therebetween. All these embodiments fulfill the initially explained function according to the same principle, in which the vibration damping is accomplished that vibration damper elements that are located between a frame adapted to the clamped in the frame stave of the weaving machine and a body projecting rigidly mounted to the side support. It would be apparent to a person skilled in the art that this principle can be embodied in designs structured differently regarding shape and arrangement.

I claim:

1. A heddle frame comprising: spaced side supports, frame staves extending between the side supports, the frame staves including a hollow space at each end, the side supports each having a projection mounted thereto, which projections are received in respective hollow spaces of the frame staves to permit connections between the side supports and the frame staves, each projection including a first rigid body securely mounted to a respective side support and including an opening, a second rigid body having a first portion adapted to be loosely received within the opening in the first rigid body and a second portion overlying at least a portion of an outer surface of the first rigid body, an elastic vibration damping element positioned between the first portion of the second rigid body and the first rigid body, and a clamp engagable with the second portion of the second rigid body for clampingly holding the second rigid body within the hollow space of the frame stave.

2. The heddle frame of claim 1, in which the first rigid body includes an integral planar rectangular frame, and in which the first portion of the second rigid body includes a planar body member which is smaller than the opening in the first rigid body to define a gap between the first rigid body and the planar body member, and in which the vibration damping element is positioned in said gap and abutting the planar body member, and wherein said second portion of said second rigid body includes a casing loosely surrounding said first rigid body.

3. The heddle frame of claim 2, in which said planar body member is of a rectangular shape and said at least one vibration damper element surrounds said planar body member and fills the space between the planar body member and first rigid body.

4. The heddle frame of claim 2, in which said planar body member is of a rectangular shape and has a longitudinal axis inclined relative to a side support longitudinal axis, and wherein the vibration damping element includes four triangular vibration dampers respectively located at corners of the opening in the first rigid body, which planar body member abuts said triangular vibration damper elements.

5. The heddle frame of claim 2, in which said planar body member is of a star-like shape and has circular arc flanks, and wherein the vibration damping element includes four disk-shaped vibration dampers respectively located at the corners of the opening in the first rigid body filling interstices between the star-like planar body member and the first rigid body, which planar body member abuts each of said vibration dampers.

6. The heddle frame of claim 2, in which the second portion of the second rigid body includes a U-shaped sheet metal enclosure encasing said first body at three sides, and a ledge member is secured to and defines a fourth side of the enclosure and extends between a pair of edges of the U-shaped sheet metal enclosure, wherein the clamp is oriented obliquely relative to the side support and acts against a clamping surface formed in said ledge, said clamping surface being inclined relative to the frame staves.

7. The heddle frame of claim 1, in which the first rigid body is a planar rectangular body having a plurality of cylindrical bores extending therethrough, and in which the first position of the second rigid body includes a number of disks corresponding to the number of the cylindrical bores, whereby the diameters of the disks are smaller than the diameters of the respective cylindrical bores and the disks are located concentrically in the bores such that an interstice is formed therebetween, and wherein the vibration damping element includes annular vibration dampers positioned within the respective interstices, and wherein the disks are rigidly mounted to a covering member loosely encasing said first rigid body.

* * * * *